US009243490B2

(12) United States Patent
Ade-Fosudo et al.

(10) Patent No.: US 9,243,490 B2
(45) Date of Patent: Jan. 26, 2016

(54) ELECTRONICALLY SET AND RETRIEVABLE ISOLATION DEVICES FOR WELLBORES AND METHODS THEREOF

(71) Applicants: Adebowale Ade-Fosudo, Houston, TX (US); Robert M. Ramirez, Houston, TX (US); Ammar Munshi, Sugar Land, TX (US)

(72) Inventors: Adebowale Ade-Fosudo, Houston, TX (US); Robert M. Ramirez, Houston, TX (US); Ammar Munshi, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 460 days.

(21) Appl. No.: 13/719,347

(22) Filed: Dec. 19, 2012

(65) Prior Publication Data

US 2014/0166277 A1 Jun. 19, 2014

(51) Int. Cl.
*E21B 33/127* (2006.01)
*E21B 33/13* (2006.01)
*E21B 47/06* (2012.01)

(52) U.S. Cl.
CPC ..... *E21B 47/06* (2013.01); *E21B 33/1275* (2013.01)

(58) Field of Classification Search
CPC ..... E21B 33/127; E21B 33/1272; E21B 33/1275; E21B 47/06
See application file for complete search history.

(56) References Cited

U.S. PATENT DOCUMENTS 927,874 A 7/1909 Robinson
2,069,212 A 2/1937 Buffington
2,196,668 A 4/1940 Ragan
2,289,164 A 7/1942 Arnold et al.
2,330,425 A 9/1943 Hilton
2,464,713 A 3/1949 Penick
2,467,822 A 4/1949 Griffin et al.
2,604,946 A 7/1952 Sweet
2,681,706 A * 6/1954 Pottorf ..... 277/333
2,720,267 A 10/1955 Brown
2,743,781 A 5/1956 Lane (Continued)

FOREIGN PATENT DOCUMENTS

GB 2230800 A 10/1990
GB 2 406 593 A 4/2005

(Continued)

OTHER PUBLICATIONS

King, George E., Permanent and Retrievable Packer Removal, Mar. 14, 2009, pp. 1-35, George E. King Engineering, Inc., USA.

(Continued)

*Primary Examiner* — Benjamin Fiorello
(74) *Attorney, Agent, or Firm* — Steve Rosenblatt

(57) ABSTRACT

Sealing devices such as packers comprise an expandable sealing element that is inflated and/or deflated by an electrically-activated pump disposed in a wellbore so that the sealing element can be set and retrieved from the wellbore. The pump is disposed downhole in close proximity to the expandable sealing element and is electronically associated with a surface processing unit located at the surface of the wellbore. In certain embodiments, an electric motor electronically associated with the surface processing unit drives the pump to flow a fluid into a chamber of the expandable sealing element to inflate the expandable sealing element and pumps the fluid out of the chamber of the expandable sealing element to deflate the expandable sealing element. Multiple sealing elements can be disposed on a tool or work string and all can be addressable and individually and separately controlled by the surface processing unit.

23 Claims, 6 Drawing Sheets

(56) References Cited

U.S. PATENT DOCUMENTS

| | | | |
|---|---|---|---|
| 2,789,004 | A | 4/1957 | Foster |
| 2,812,025 | A | 11/1957 | Teague et al. |
| 2,880,806 | A | 4/1959 | Davis |
| 2,970,651 | A | 2/1961 | Roberts |
| 3,036,639 | A | 5/1962 | Baker |
| 3,085,627 | A | 4/1963 | Sodich |
| 3,171,492 | A | 3/1965 | Cochran |
| 3,268,275 | A | 8/1966 | Laughlin |
| 3,364,993 | A | 1/1968 | Uvon |
| 3,436,084 | A | 4/1969 | Courter |
| 3,554,280 | A | 1/1971 | Tucker |
| 3,926,254 | A | 12/1975 | Evans et al. |
| 3,952,656 | A | 4/1976 | Fox et al. |
| 4,258,926 | A | 3/1981 | Upton |
| 4,285,400 | A | 8/1981 | Mullins, II |
| 4,313,495 | A | 2/1982 | Brandell |
| 4,378,051 | A | 3/1983 | Cholet et al. |
| 4,441,551 | A | 4/1984 | Biffle |
| 4,452,463 | A | 6/1984 | Buckner |
| 4,458,752 | A | 7/1984 | Brandell |
| 4,469,172 | A | 9/1984 | Clark |
| 4,488,740 | A | 12/1984 | Baugh et al. |
| 4,573,537 | A | 3/1986 | Hirasuna et al. |
| 4,615,544 | A | 10/1986 | Baugh |
| 4,685,516 | A | 8/1987 | Smith et al. |
| 4,706,746 | A | 11/1987 | White et al. |
| 4,729,430 | A | 3/1988 | White et al. |
| 4,744,421 | A | 5/1988 | Wood et al. |
| 4,787,446 | A | 11/1988 | Howell et al. |
| 4,793,424 | A | 12/1988 | Lim, Jr. |
| 4,877,086 | A | 10/1989 | Zunkel |
| 4,900,067 | A | 2/1990 | Jansen et al. |
| 5,097,902 | A | 3/1992 | Clark |
| 5,193,616 | A | 3/1993 | Hynes |
| 5,203,412 | A | 4/1993 | Doggett |
| 5,207,272 | A | 5/1993 | Pringle et al. |
| 5,220,959 | A | 6/1993 | Vance, Sr. |
| 5,236,047 | A | 8/1993 | Pringle et al. |
| 5,257,663 | A | 11/1993 | Pringle et al. |
| 5,291,947 | A | 3/1994 | Stracke |
| 5,320,182 | A | 6/1994 | Mendez |
| 5,327,962 | A | 7/1994 | Head |
| 5,343,963 | A | 9/1994 | Bouldin et al. |
| 5,466,537 | A | 11/1995 | Diede et al. |
| 5,540,280 | A | 7/1996 | Schultz et al. |
| 5,542,473 | A | 8/1996 | Pringle |
| 5,577,560 | A | 11/1996 | Coronado et al. |
| 5,613,557 | A | 3/1997 | Blount et al. |
| 5,701,959 | A | 12/1997 | Hushbeck et al. |
| 5,833,001 | A | 11/1998 | Song et al. |
| 5,849,188 | A | 12/1998 | Voll et al. |
| 5,849,198 | A | 12/1998 | Sharpless |
| 5,934,375 | A | 8/1999 | Peterson |
| 5,936,913 | A | 8/1999 | Gill et al. |
| 5,975,205 | A | 11/1999 | Carisella |
| 6,006,834 | A | 12/1999 | Skinner |
| 6,006,835 | A | 12/1999 | Onan et al. |
| 6,009,951 | A | 1/2000 | Coronado et al. |
| 6,055,213 | A | 4/2000 | Rubbo et al. |
| 6,102,117 | A | 8/2000 | Swor et al. |
| 6,102,120 | A | 8/2000 | Chen et al. |
| 6,142,227 | A | 11/2000 | Hiorth et al. |
| 6,173,788 | B1 | 1/2001 | Lembcke et al. |
| 6,173,969 | B1 | 1/2001 | Stoll et al. |
| 6,203,020 | B1 | 3/2001 | Mireles, Jr. et al. |
| 6,341,654 | B1 | 1/2002 | Wilson et al. |
| 6,343,796 | B1 | 2/2002 | Lee et al. |
| 6,361,049 | B1 | 3/2002 | Joco |
| 6,390,479 | B1 | 5/2002 | Combet et al. |
| 6,431,273 | B1 | 8/2002 | McGarian et al. |
| 6,497,416 | B1 | 12/2002 | Morvant |
| 6,571,876 | B2 | 6/2003 | Szarka |
| 6,626,243 | B1 | 9/2003 | Go Boncan |
| 6,712,153 | B2 | 3/2004 | Turley et al. |
| 6,769,491 | B2 | 8/2004 | Zimmerman et al. |
| 6,772,844 | B2 | 8/2004 | Lloyd et al. |
| 6,779,601 | B2 | 8/2004 | Wilson et al. |
| 6,798,350 | B2 | 9/2004 | Maxit et al. |
| 6,834,725 | B2 | 12/2004 | Whanger et al. |
| 6,843,315 | B2 | 1/2005 | Coronado et al. |
| 6,843,480 | B2 | 1/2005 | Nelson et al. |
| 6,854,522 | B2 | 2/2005 | Brezinski et al. |
| 6,962,206 | B2 | 11/2005 | Hirth et al. |
| 7,165,622 | B2 | 1/2007 | Hirth et al. |
| 7,188,691 | B2 | 3/2007 | Yong et al. |
| 7,204,525 | B2 | 4/2007 | Matzner |
| 7,210,533 | B2 | 5/2007 | Starr et al. |
| 7,213,814 | B2 | 5/2007 | Hurlbert et al. |
| 7,322,410 | B2 | 1/2008 | Vinegar et al. |
| 7,331,581 | B2 | 2/2008 | Xu et al. |
| 7,363,970 | B2 | 4/2008 | Corre et al. |
| 7,387,165 | B2 | 6/2008 | Lopez de Cardenas et al. |
| 7,448,445 | B2 | 11/2008 | Doane et al. |
| 7,478,679 | B2 | 1/2009 | Berzin et al. |
| 7,610,964 | B2 | 11/2009 | Cox |
| 7,617,880 | B2 | 11/2009 | Loughlin |
| 7,703,542 | B2 | 4/2010 | O'Connor et al. |
| 7,726,407 | B2 | 6/2010 | Wood et al. |
| 7,743,835 | B2 | 6/2010 | Willauer |
| 7,748,468 | B2 | 7/2010 | Casciaro |
| 7,806,177 | B2 | 10/2010 | Bishop et al. |
| 7,806,192 | B2 | 10/2010 | Foster et al. |
| 7,806,193 | B2 | 10/2010 | Berzin et al. |
| 7,845,402 | B2 | 12/2010 | O'Connor et al. |
| 7,886,818 | B1 | 2/2011 | O'Connor et al. |
| 7,891,433 | B2 | 2/2011 | Vinson et al. |
| 7,931,093 | B2 | 4/2011 | Foster et al. |
| 7,938,192 | B2 | 5/2011 | Rytlewski |
| 8,016,295 | B2 | 9/2011 | Guest et al. |
| 8,037,942 | B2 | 10/2011 | Vinson et al. |
| 2003/0080515 | A1 | 5/2003 | Milberger et al. |
| 2003/0131988 | A1 | 7/2003 | Wilson et al. |
| 2004/0112609 | A1 | 6/2004 | Whanger et al. |
| 2004/0129432 | A1 | 7/2004 | Wills et al. |
| 2004/0134659 | A1 | 7/2004 | Hoffman et al. |
| 2005/0023003 | A1 | 2/2005 | Echols et al. |
| 2005/0067170 | A1 | 3/2005 | Richard |
| 2005/0161229 | A1 | 7/2005 | Doane et al. |
| 2005/0199401 | A1 | 9/2005 | Patel et al. |
| 2005/0284633 | A1 | 12/2005 | Richard |
| 2006/0124310 | A1 | 6/2006 | Lopez de Cardenas et al. |
| 2006/0186602 | A1 | 8/2006 | Martin et al. |
| 2007/0039160 | A1 | 2/2007 | Turley et al. |
| 2007/0056725 | A1 | 3/2007 | Lucas et al. |
| 2007/0125532 | A1 | 6/2007 | Murray et al. |
| 2007/0144734 | A1 | 6/2007 | Xu et al. |
| 2007/0193736 | A1 | 8/2007 | Corre et al. |
| 2007/0289749 | A1 | 12/2007 | Wood et al. |
| 2007/0290454 | A1 | 12/2007 | Garrison et al. |
| 2008/0087417 | A1 | 4/2008 | Doane et al. |
| 2008/0110625 | A1 | 5/2008 | Arcement et al. |
| 2008/0135260 | A1 | 6/2008 | Berzin et al. |
| 2008/0149351 | A1 | 6/2008 | Marya et al. |
| 2008/0156501 | A1 | 7/2008 | Vinson et al. |
| 2008/0264647 | A1 | 10/2008 | Li |
| 2008/0283236 | A1 | 11/2008 | Akers et al. |
| 2008/0302543 | A1 | 12/2008 | O'Connor et al. |
| 2009/0126947 | A1 | 5/2009 | King |
| 2009/0139707 | A1 | 6/2009 | Berzin et al. |
| 2009/0173490 | A1 | 7/2009 | Dusterhoft et al. |
| 2009/0183882 | A1 | 7/2009 | Van Zuilekom et al. |
| 2009/0211767 | A1 | 8/2009 | Nutley et al. |
| 2009/0211770 | A1 | 8/2009 | Nutley et al. |
| 2009/0242214 | A1 | 10/2009 | Foster et al. |
| 2009/0255675 | A1 | 10/2009 | Casciaro |
| 2009/0255690 | A1 | 10/2009 | Conner et al. |
| 2009/0308656 | A1 | 12/2009 | Chitwood et al. |
| 2010/0071908 | A1 | 3/2010 | Bishop et al. |
| 2010/0078180 | A1 | 4/2010 | O'Connor et al. |
| 2010/0155050 | A1 | 6/2010 | Frazier |
| 2010/0230094 | A1 | 9/2010 | Foster et al. |
| 2010/0230902 | A1 | 9/2010 | Castillo et al. |
| 2011/0005778 | A1 | 1/2011 | Foster et al. |
| 2011/0036560 | A1 | 2/2011 | Vail, III et al. |

(56) References Cited

U.S. PATENT DOCUMENTS

| | | | |
|---|---|---|---|
| 2011/0036561 | A1 | 2/2011 | Bishop et al. |
| 2011/0259587 | A1 | 10/2011 | Joseph et al. |
| 2012/0037355 | A1 | 2/2012 | Bishop et al. |
| 2012/0067564 | A1 | 3/2012 | Mack et al. |
| 2012/0119445 | A1 | 5/2012 | Castillo et al. |
| 2012/0305253 | A1 | 12/2012 | O'Malley |
| 2012/0312559 | A1 | 12/2012 | Bailey et al. |

FOREIGN PATENT DOCUMENTS

| | | |
|---|---|---|
| WO | WO 86/02971 | 5/1986 |
| WO | WO 95/23908 | 9/1995 |

OTHER PUBLICATIONS

J.D. Burley, et al., Recent Developments in Packer Seal Systems for Sour Oil and Gas Wells, Oct. 9-12, 1977, pp. 1-8, SPE 6762, American Institute of Mining, Metallurgical, and Petroleum Engineers, Inc., U.S.A.

D.D. Onan, et al., Elastomeric Composites for Use in Well Cementing Operations, Oct. 3-6, 1993, pp. 593-608, SPE 26572, Society of Petroleum Engineers, Inc., U.S.A.

Thomas W. Ray, High Pressure/High Temperature (HP/HT) Seals for Oil and Gas Production, Feb. 17-19, 1998, pp. 603-614, SPE 39573, Society of Petroleum Engineers, Inc., U.S.A.

Product Report, ZXP Compression Set Liner Packer, Sep. 2001, Baker Hughes Incorporated, Houston, Texas, USA.

Gordon MacKenzie, et al., Wellbore Isolation Intervention Devices Utilizing a Metal-to-Metal Rather Than an Elastomeric Sealing Methodology, Nov. 11-14, 2007, pp. 1-5, SPE 109791, Society of Petroleum Engineers, Inc., U.S.A.

S. Yakeley, et al., Swellable Packers for Well Fracturing and Stimulation, Nov. 11, 2007, pp. 1-7, SPE 110621, Society of Petroleum Engineers, U.S.A.

* cited by examiner

ELECTRONICALLY SET AND RETRIEVABLE ISOLATION DEVICES FOR WELLBORES AND METHODS THEREOF

BACKGROUND

1. Field of Invention

The invention is directed to sealing devices for isolating an annulus of an open-hole or cased oil, gas, and/or water wellbore and, in particular, to electronically set and retrievable sealing devices for use in open-hole formations that are capable of being electronically inflated and deflated.

2. Description of Art

Packers for isolating intervals and/or sealing the annulus of wellbores are known in the art. For example, some packers include an expandable elastomeric sealing element such as a rubber casing or balloon. These types of packers expand and, thus, seal to the inner wall surface of a wellbore by pumping a fluid into the rubber casing to expand the rubber casing into contact with the wellbore.

Some of these types of packers also include a swellable material within the rubber casing so that the swellable material, and not the fluid pressure itself, inflates the rubber casing. In these packers, the swellable material is contacted by hydraulic fluid or other fluid so that the swellable materials absorb the fluid and expand. In one type of these packers, for example, hydraulic fluid is pumped down a string of tubing having the packer secured thereto. The hydraulic fluid travels down the bore of the string of tubing and through a port that is in fluid communication with an inner cavity of the rubber casing. Swellable materials disposed within the rubber casing are contacted by the hydraulic fluid. As a result, the swellable materials absorb the fluid and expand. As the swellable materials expand and hydraulic fluid is pumped into the rubber casing, the rubber casing expands to seal the wellbore. After expansion, hydraulic fluid pressure is decreased and the rubber casing remains held in the expanded position solely by the swellable materials having absorbed the fluid.

Other packers are formed of an elastomeric material that is compressed or otherwise forced into the inner wall surface of the wellbore such as by expanding casing or axially compressing the elastomeric material that is disposed along an outer wall surface of the packer assembly.

SUMMARY OF INVENTION

Broadly, the sealing devices disclosed herein comprise an expandable sealing element that is inflated by a fluid being pumped into the expandable sealing element to set the sealing device in an open-hole wellbore. Thereafter, the fluid can be released from the expandable sealing element to deflate the expandable sealing element allowing the sealing device to be retrieved from the wellbore or to allow fluid to travel from outside of the zone previously isolated by the inflated expandable sealing element into the zone previously isolated by the inflated expandable sealing element. The expandable sealing element can be inflated electronically by a pump device that is capable of forcing fluid into the expandable sealing element and can be deflated by the same pump or by or in conjunction with another device such as a second pump, a one-way solenoid actuated valve, and the like.

The inflation and deflation of the expandable sealing element is controlled by an electronics package disposed on, adjacent to, or in close proximity of the sealing device. In one particular embodiment, the electronics package includes an electronic communication line in electronic communication with a downhole power supply and communications interface, and a surface control device such as a computer. A motor, motor encoder, and microcontroller operatively associated with a pump and a pump position encoder can also be included as part of the electronics package. In specific embodiments, multiple sealing devices can be located along a single string, each with its own electronics package. In these specific embodiments, control systems at the surface can address and choose which sealing device to operate, independent of the other sealing device(s).

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
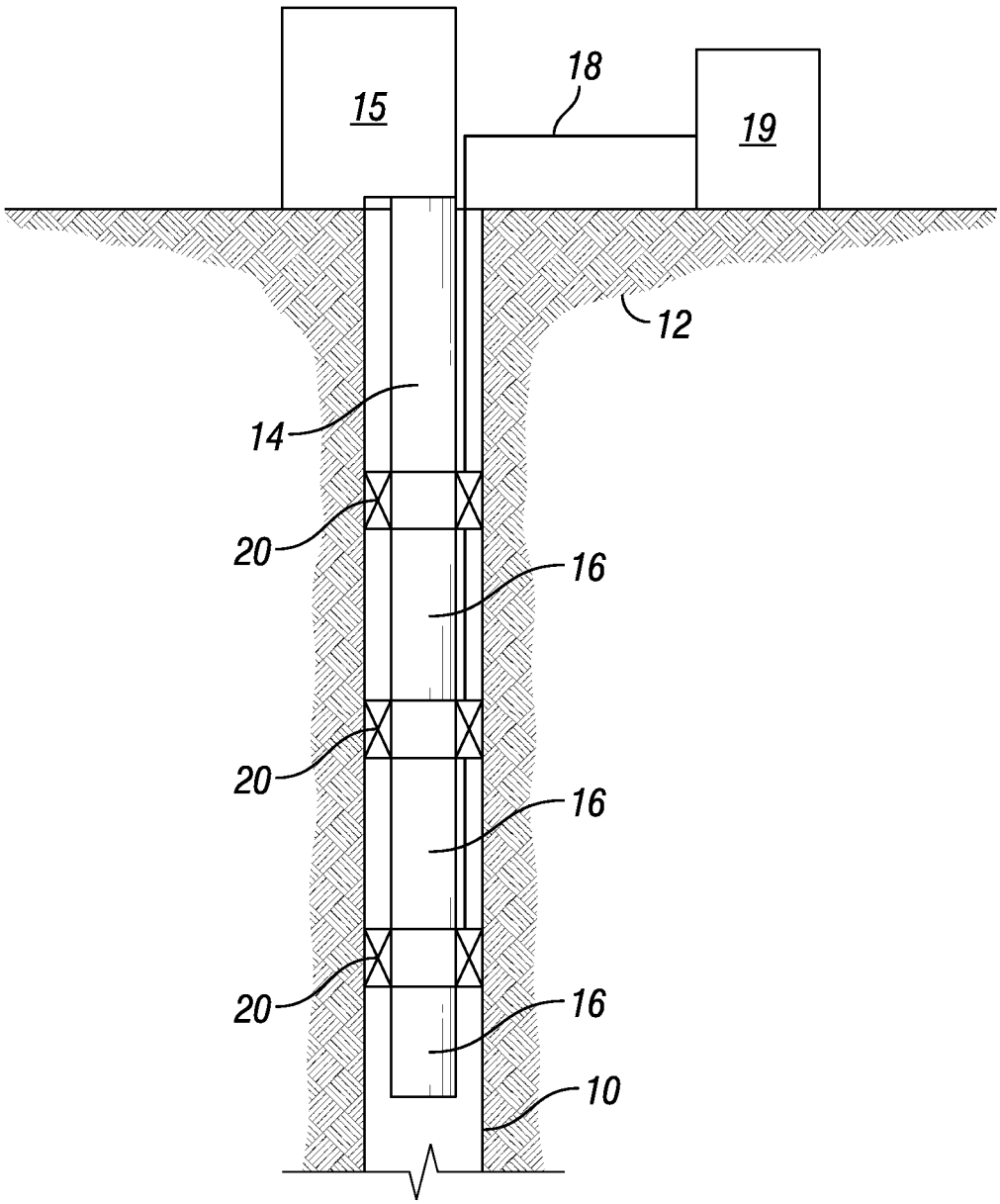
FIG. 1 is a schematic of an open-hole wellbore showing disposed therein a tool string having sealing devices disclosed herein.

Referring now to the Figures, FIG. 1 shows a schematic of an open-hole wellbore having disposed therein sealing devices disclosed herein. As shown in FIG. 1, open-hole wellbore 10 is disposed in formation 12 having inner wall surface 13. Disposed in open-hole wellbore 10 is work or tool string 14 operatively associated with wellhead equipment 15. In the embodiment of FIG. 1, tool string 14 includes three sealing devices 20 and three fluid control valves 16. It is to be understood, however, that less than three or more than three of each of sealing devices 20 and fluid control valves 16 can be included as part of tool string 14. Each of sealing devices 20 and fluid control valves 16 are operatively associated with electronic communication line 18. Electronic communication lines 18 can include a tubing encapsulated conductor ("TEC") such as those known in the art. Electronic communication line 18 is electronically associated with surface processing unit 19 which can be a computer having appropriate software installed thereon for controlling sealing devices 20 and fluid control valves 16. Thus, surface processing unit 19 can allow a local operator located at the wellbore or remote operator using a telecommunications network to monitor the operation of sealing devices 20 and to instruct sealing devices 20 to inflate or deflate as desirable.

Figure 2:
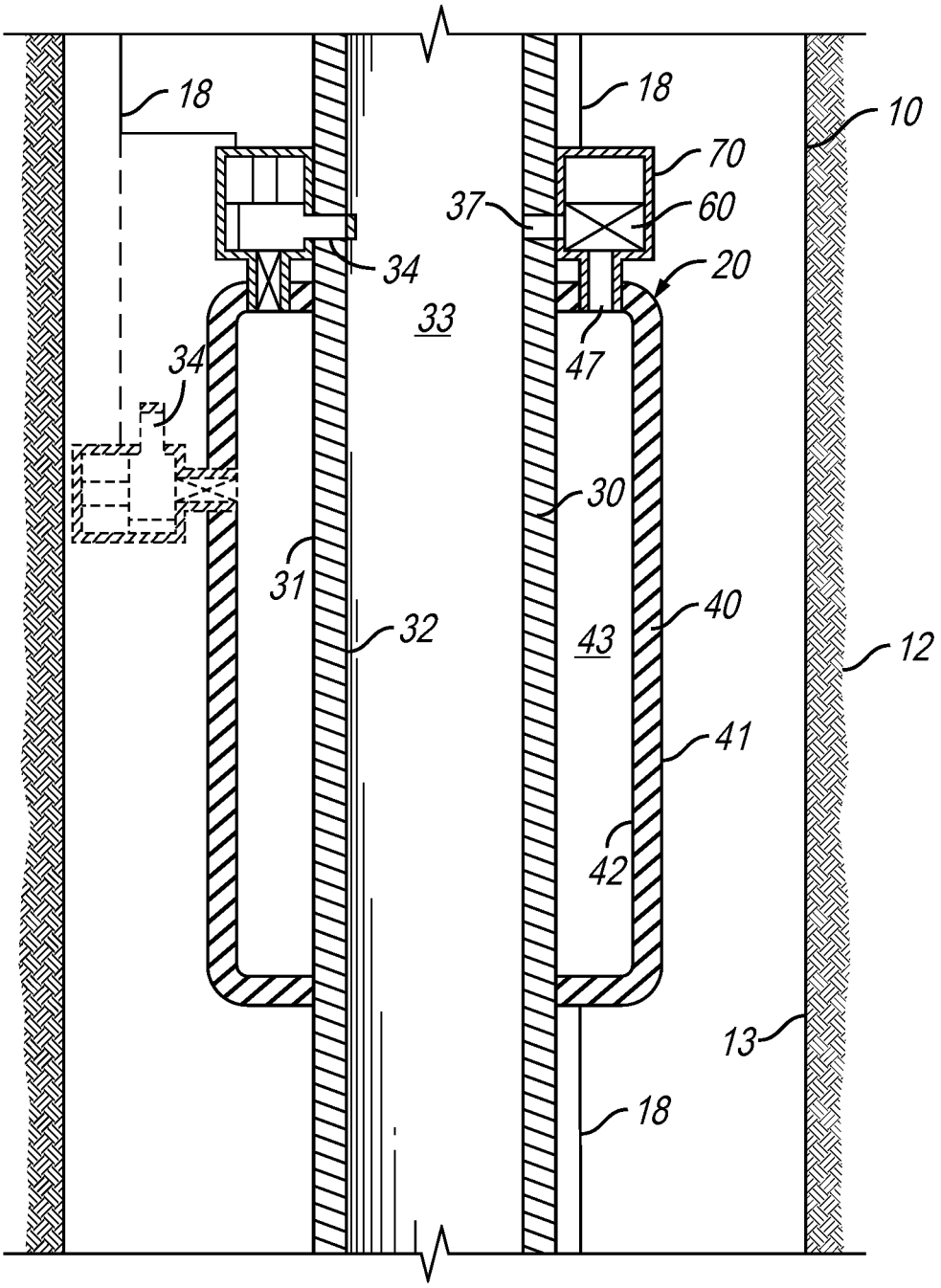
FIG. 2 is a partial cross-sectional/partial schematic view of a sealing device disclosed herein shown in its run-in position.
Figure 3:
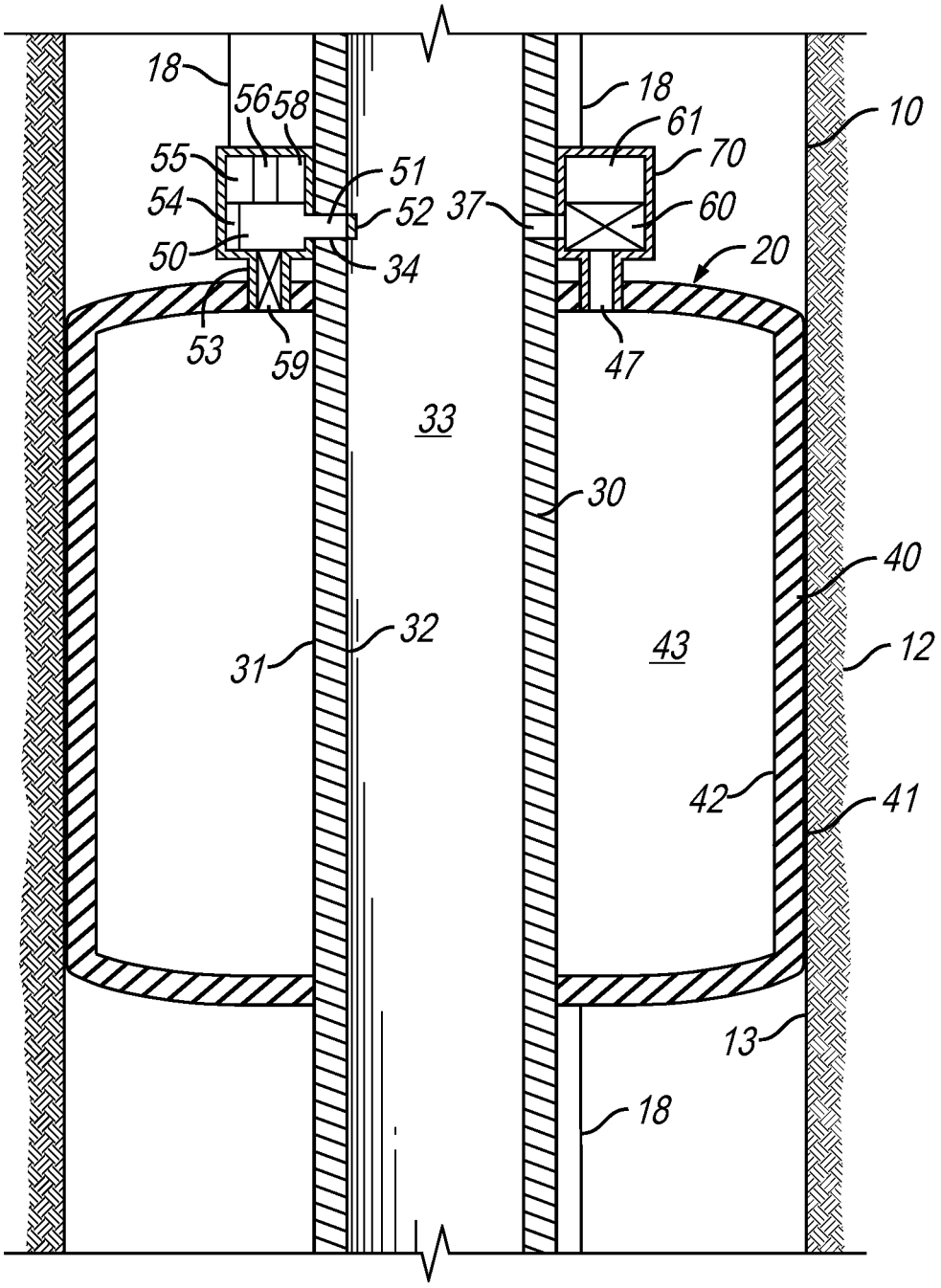
FIG. 3 is a partial cross-sectional/partial schematic view of the sealing device of FIG. 2 shown in its set position.

Referring now to FIGS. 2-3, sealing device 20, such as a packer, includes mandrel 30 having mandrel outer wall surface 31, mandrel inner wall surface 32 defining mandrel bore 33, and mandrel port 34 disposed through mandrel outer wall surface 31 and mandrel inner wall surface 32 and in fluid communication with mandrel bore 33. In the embodiment of FIGS. 2-3, mandrel 30 also includes deflation port 37, although it is to be understood that deflation port 37 is not required. In embodiments that do not include deflation port 37, sealing device 20 is moved to and from the set position by fluid flowing through an inflation port shown as mandrel port 34. In still other embodiments (not shown), mandrel port 34 is absent and sealing device 20 is moved to and from the set position by fluid flowing through a port in fluid communication with the wellbore annulus 10. In these embodiments, an inflation port and deflation port are in fluid communication with wellbore annulus 10 and sealing element chamber 43 (discussed below). Thus, mandrel bore 33 is isolated from sealing element chamber 43.

Disposed on mandrel outer wall surface 31 is expandable sealing element 40. Expandable sealing element 40 includes sealing element outer wall surface 41, and sealing element inner wall surface 42 defining sealing element chamber 43. Expandable sealing element 40 can be formed out of any material known in the art, including but not limited to elastomeric materials, rubber, and the like.

Although expandable sealing element 40 is shown in the particular embodiment of FIGS. 2-3 as being disposed on a mandrel of a downhole tool, it is to be understood that expandable sealing element 40 can be disposed on the mandrel of production tubing or on the mandrel of a casing string.

In addition, in certain embodiment, expandable sealing element 40 is expanded by pumping cement or other fluid down the casing and is compatible with ongoing cementing operations. Thus, expandable sealing element 40 can provide reliable zonal isolation in cemented or non-cemented completions and can be used in conjunction with liners or long-string casing.

Sealing, element chamber 43 is in selective fluid communication with mandrel port 34 by electronically activated pump 50. Pump 50 is preferably a positive displacement pump such as those known in the art. In certain embodiments, pump 50 is reversible. Preferably, pump 50 allows full control of inflation and deflation of expandable sealing element 40. All variations of pump 50 are known in the art.

In the embodiment of FIGS. 2-3, pump 50 includes inlet 51 having filter or screen 52 disposed therein for filter debris out of the fluid flowing through pump 50, and outlet 53. Although the terms "inlet" and "outlet" are used, it is to be understood that these designations do not require that fluid always flow in a particular direction as might be suggested by the terms "inlet" and "outlet." To the contrary, fluid can flow both directions through both inlet 51 and outlet 53 to inflate or deflate expandable sealing element 40. Thus, pump 50 pressurizes and depressurizes expandable sealing element 40.

In the embodiment of FIGS. 2-3, pump 50 is operatively associated with power source 54. Power source 54 is responsible for pulling power from electronic communication line 18 and converting the voltage from electronic communication line 18 to voltages acceptable to the electronics forming the electronics package, e.g., pump 50, electric motor 55, etc. Power source 54 also contains circuitry that interfaces to electronic communication line 18 to allow microcontroller 58 to encode and decode commands to and from surface processing unit 19.

Figure 4:
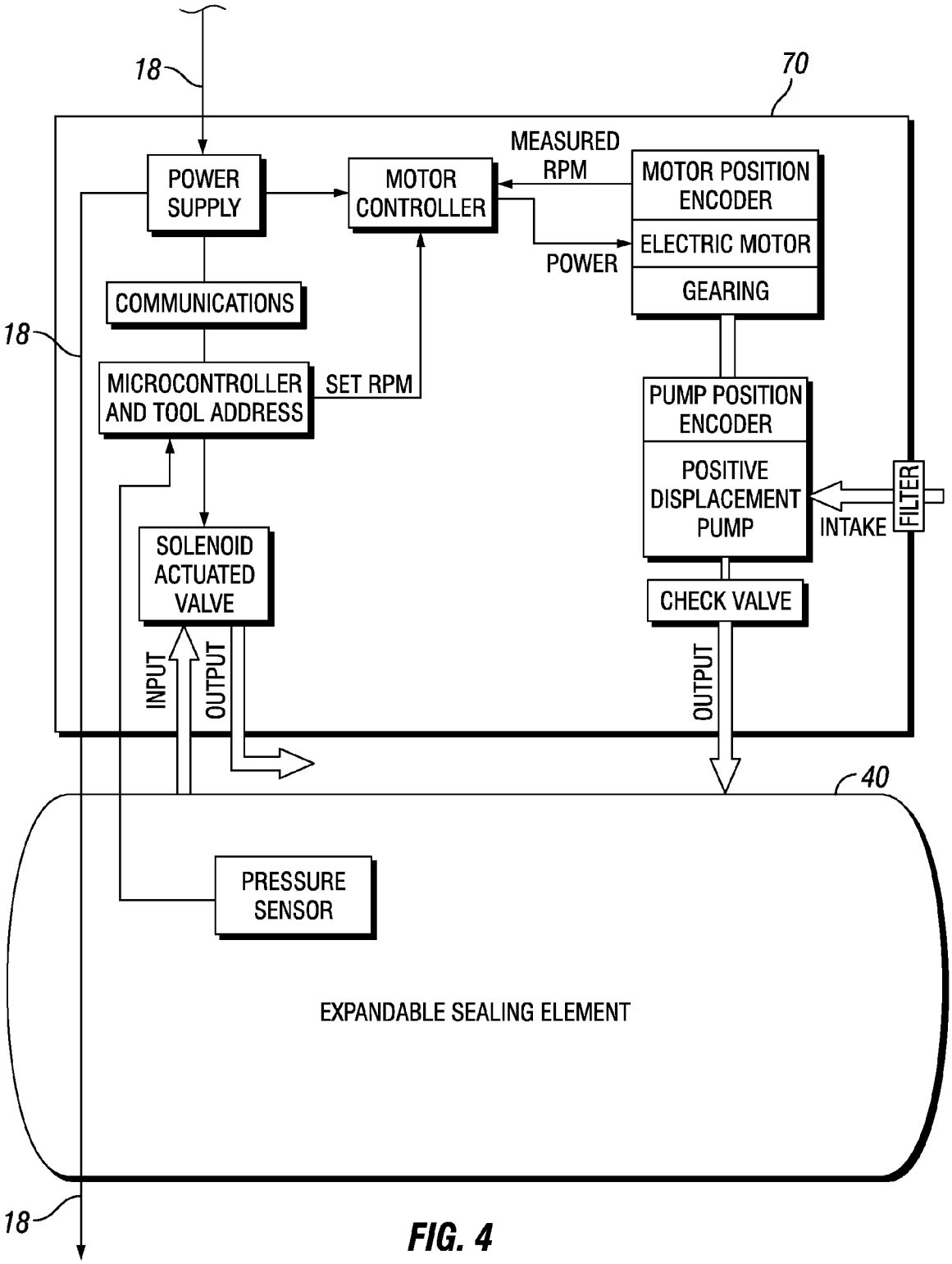
FIG. 4 is a schematic view of the electronics and pump package of the sealing device of FIG. 2.

To facilitate the action of pump 50, and to facilitate holding pump 50 in a desired position such as to keep expandable sealing element 40 in a set position (FIG. 3), pump 50 and pump position encoder 61 in the embodiment of FIGS. 2-3 also are operatively associated with electronically activated motor 55 and motor position encoder 56. Motor 55 can be Article 273763 35 mm Graphite Brushes Electric Motor 90 available from Maxon Motor located in Sachseln, Switzerland; and motor encoder 55 can be Model No. RMB20SC available from Renishaw Plc located in Wotton-under-Edge, United Kingdom. Motor 55 drives pump 50 and motor position encoder 56 identifies the orientation of the drive shaft (not shown) of motor 55 and communicates this orientation to the motor controller (shown schematically in FIG. 4). Pump 50 and pump position encoder 61 are operative associated with each other. Pump position encoder 61 provides the motor controller with the orientation of pump 50 so that pump 50 will be stopped by the motor controller such that the intake and exhaust valves of pump 50 are in the closed position. In this embodiment, power source 54 is operatively associated with motor 55 and motor position encoder 56.

In embodiments containing motor 55, the motor controller is responsible for receiving specific revolutions per minute (RPM) commands from microcontroller 58. The RPM commands are converted by the motor controller into motor driving signals that are sent to the electric motor inputs of motor 55. The motor controller operatively associated with motor 55 receives position information feedback from motor position encoder 56. This feedback allows precise closed loop control of the RPMs of motor 55 and, therefore, the inflation rate.

Also operatively associated with at least pump 50, but can also be operatively associated with one or more of power source 54, pump position encoder 61, motor 55, or motor position encoder 56 is microcontroller 58. Microcontroller 58 can be any microcontroller known in the art that is capable of being programmed to be controlled by surface processing unit 19, either actively or passively. In active control, surface processing unit 19 manually instructs microcontroller 58 to activate or deactivate pump 50. In passive control, microcontroller 58 is preprogrammed to activate or deactivate pump 50 at predetermine circumstances such as pressure. In certain embodiments, microcontroller 58 is programmed with sealing device specific identifying information so that each sealing device 20 disposed on a tool or work string is addressable. That is, each sealing device 20 can be controlled and, thus, inflated or deflated, separately from any other sealing device 20 disposed on the same tool or work string. In such embodiments, microcontroller 58 listens for commands sent to its tool address and turns on or off pump 50 accordingly. In addition, microcontroller 58 can be programmed with a desired pressure of expandable sealing element 40 (received from surface processing unit 19) and will electronically activate motor 55 to drive pump 50 to run until the desired pressure is reached. A pressure sensor (not shown) can be included to monitor the pressure within sealing element chamber 43 to turn-off pump 50 when the desired pressure is reached. Thus, using the pressure sensor for closed loop control, microcontroller 58 sends commands to pump 50. In embodiments having electric motor 55, microcontroller 58 sends RPM commands to the motor controller to turn on or turn off motor 55 and, thus, turn on or turn off pump 50. As a result, the pressure within sealing element chamber 43 can be precisely controlled.

Pump 50, motor 55, motor position encoder 56, and microcontroller 58 are in electronic communication with surface processing unit 19 through electronic communication line 18. As noted above, electronic communication line 18 can be a tubing encapsulated conductor ("TEC") or any other electronic communications line known in the art. One suitable electronic control line and its arrangement for communication with downhole tools is disclosed and described in U.S.

Pat. No. 6,173,788 issued to Lembcke, et al. which is hereby incorporated by reference herein in its entirety. In addition, the electronic communication system for controlling pump 50 and, if present, motor 55, motor position encoder 56, and microcontroller 58 can be any communication system known in the art. One suitable electronic communication system and its arrangement for control of downhole tools and operations is disclosed and described in U.S. Pat. No. 6,798,350 issued to Maxit, et al. which is hereby incorporated by reference herein in its entirety.

In the embodiment of FIGS. 2-3, pump 50, power source 54, motor 55, motor position encoder 56, and microcontroller 58 are contained within housing 70 which is secured to outer wall surface 31 of mandrel 30. It is to be understood, however, that housing 70 is not required. Instead, pump 50 and the other components, if included, can be disposed in a sub-assembly disposed above or below expandable sealing element 40 or disposed at any other location within or along mandrel 30 near-by expandable sealing element 40.

In the embodiment of FIGS. 2-3, outlet 53 includes valve 59. Valve 59 can be a one-way check valve such that fluid can flow in only one direction through pump 50, i.e., from mandrel bore 33, through inlet 51 and through outlet 53. In such an embodiment, deflation valve 60 disposed in fluid communication with deflation passage 47 and deflation port 37 can be included within housing 70 to facilitate removal of fluid from sealing element chamber 43 during deflation of expandable sealing element 40. In such embodiments, deflation valve 60 is operatively associated with surface processing unit 19, in either direction through electronic communication line 18, or through microcontroller 58.

In operation, a sealing device such as a packer described above with respect to FIGS. 2-3, is placed in a tool sting and lowered into an open-hole wellbore to a desired depth. Upon reaching the desired location, an electronic signal is sent from the surface processing unit located at the wellbore surface through an electronic communication line, such as a tubing encapsulated conductor line, to the electrical pump located downhole on or adjacent the sealing device. The pump is activated due to the electronic signal and fluid is moved from outside the expandable sealing element into the sealing element chamber causing the expandable sealing element to expand or inflate. In certain embodiments, the fluid is pumped from a bore of the work or tool string carrying the sealing device. In other embodiments, the fluid is a wellbore fluid pumped from a wellbore annulus.

To facilitate activation of the pump, in some embodiments a microcontroller and/or a motor are operatively associated with the pump. In addition, a pressure sensor can also be operatively associated with the pump. In these embodiments, the motor causes the pump to flow the fluid into the sealing element chamber, the microcontroller activates and controls the RPM of the motor, and the pressure sensor detects the pressure created within the sealing element chamber and relays this information to the microcontroller. When a predetermined pressure that is programmed in the microcontroller is reached, the microcontroller shuts off the motor.

Continuous monitoring of the current pressure inside sealing element chamber 43 allows any changes to be detected which would indicate that the pressure within the sealing element chamber is leaking. If such a situation occurs, then the motor should be reactivated to pump additional fluid into the sealing element chamber.

In certain embodiments, the microcontroller is programmed with predetermined parameters such that the microcontroller performs the operation of monitoring the orientation of the motor shaft. In these embodiments, if the motor shaft moves past a predetermined position, e.g., 1-5% off from its position when the motor is turned off, the microcontroller automatically turns the motor on so that the pump can flow additional fluid into the sealing element chamber. Thus, the microcontroller facilitates ensuring that the desired pressure remains in the sealing element chamber. In a similar fashion, the pump position encoder can be monitored and any changes in position outside a threshold would cause the motor and pump to be activated.

As persons skilled in the art will recognize, the microcontroller can be programmed and reprogrammed as desired or necessary by an operator operating the surface processing unit. Similarly, the surface processing unit and the software installed thereon can be modified as desired or necessary to facilitate performance of the inflation of the expandable sealing element to the desired pressure, and maintaining the expandable sealing element at the desired inflated pressure.

As a result of inflation of the expandable sealing element, a seal is created between the outer wall surface of the expandable sealing element and a sealing surface disposed as an inner wall surface of the open-hole wellbore, e.g., on the formation itself, or on an inner wall surface of a cased wellbore. As described above, because inflation of the expandable sealing element is controlled by the pump, the pump can be held in a fixed orientation to maintain the expandable sealing element in the inflated or set position.

Thereafter, if desired, the pump can be activated by sending an electronic signal through the electronic control line to the pump to reverse direction. Alternatively, the electronic signal can be sent to the microcontroller. As a result, the pump is activated to cause fluid within the sealing element chamber to be flowed out of the sealing element chamber, either into the bore of the tool or work string containing the sealing device, or into the wellbore annulus. Thus, the pump actively causes deflation of the expandable sealing element. Deflation of the expandable sealing element can be monitored by the motor, motor position encoder, pump position encoder, pressure sensor and/or microcontroller in a similar manner as during inflation. For example, the pressure sensor can be operatively associated with the microcontroller which is programmed with a predetermined shut-off pressure at which the microcontroller sends an electronic signal to the motor or pump to stop the pump from operating.

After deflation of the expandable sealing element, the sealing device can be re-located within the wellbore by moving the tool or work string upward or downward within the wellbore and the process of inflation repeated. Alternatively, the sealing device can be removed or retrieved from the wellbore.

In other alternative methods, the sealing device can be deflated to allow fluid communication between two zones of the wellbore that were previously isolated by the sealing device. For example, in an embodiment in which two or more sealing devices are included in a work or tool string, and both sealing devices are inflated to create an upper isolated zone and a lower isolated zone, the lower sealing device can be deflated to allow the upper and lower isolated zones to be placed in fluid communication with each other. Such a situation may be desirable where a well completion including fluid flow control valve disposed in the tool or work string below the lower sealing device fails and fluids desired to be flowed out of the wellbore from the lower zone are trapped. In such a situation, the lower sealing device can be deflated to allow the trapped fluid to flow from the lower zone into the upper zone where a functioning fluid control valve can flow the previously trapped fluid through the tool or work string without the need for an intervention operation or recompletion of the well.

In other embodiments, the sealing devices can be used as part of a casing string which is run into a cased wellbore. Cement is then pumped downhole to create a plug in the wellbore. Water is then pumped down on top of the cement. Alternatively, water or other fluid may be disposed within the well due to seepage from the formation or through the cement plug. Thereafter, the pump is activated through one or more of the methodologies discussed above to cause the water or other fluid to be pumped into the sealing chamber of the expandable sealing element causing the expandable sealing element to inflate and seat against an inner wall surface of the wellbore. Disposing the sealing device above the cemented plug mitigates gas migration from reaching the surface of the well that might otherwise have migrated through microfractures contained in the cement plug. To further reduce gas migration to the surface, a second cement plug can be installed above the sealing device to provide greater mitigation of gas migration.

Figure 6:
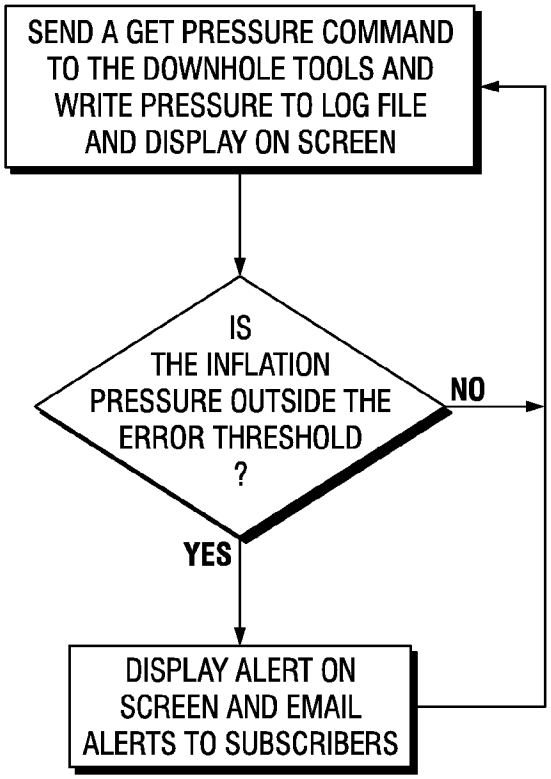
FIG. 6 is a flow-chart showing acquisition and monitoring steps performed by software loaded into the surface processing unit and/or the microcontroller in one specific embodiment of the operation of the sealing device of FIG. 2.
Figure 5:
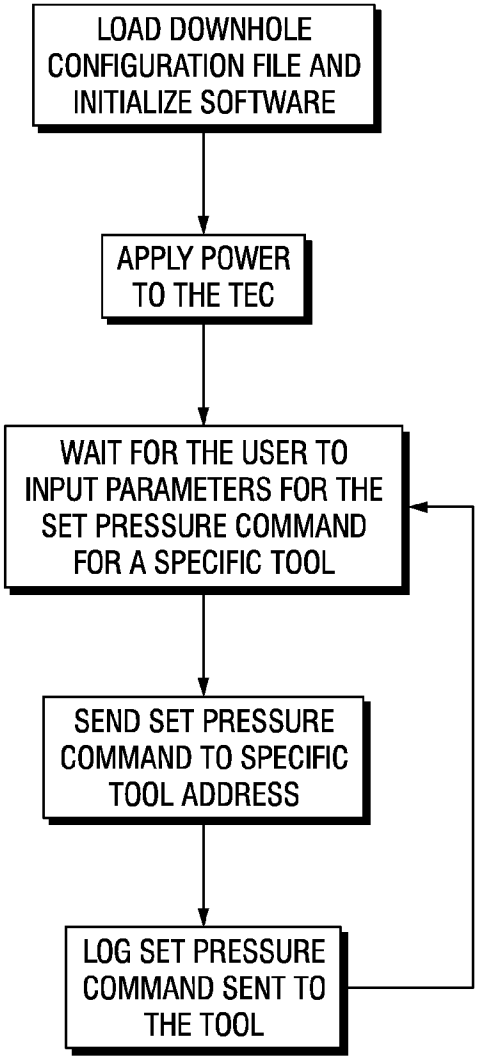
FIG. 5 is a flow-chart showing start-up steps performed by software loaded into the surface processing unit and/or the microcontroller in one specific embodiment of the operation of the sealing device of FIG. 2.
Figure 7:
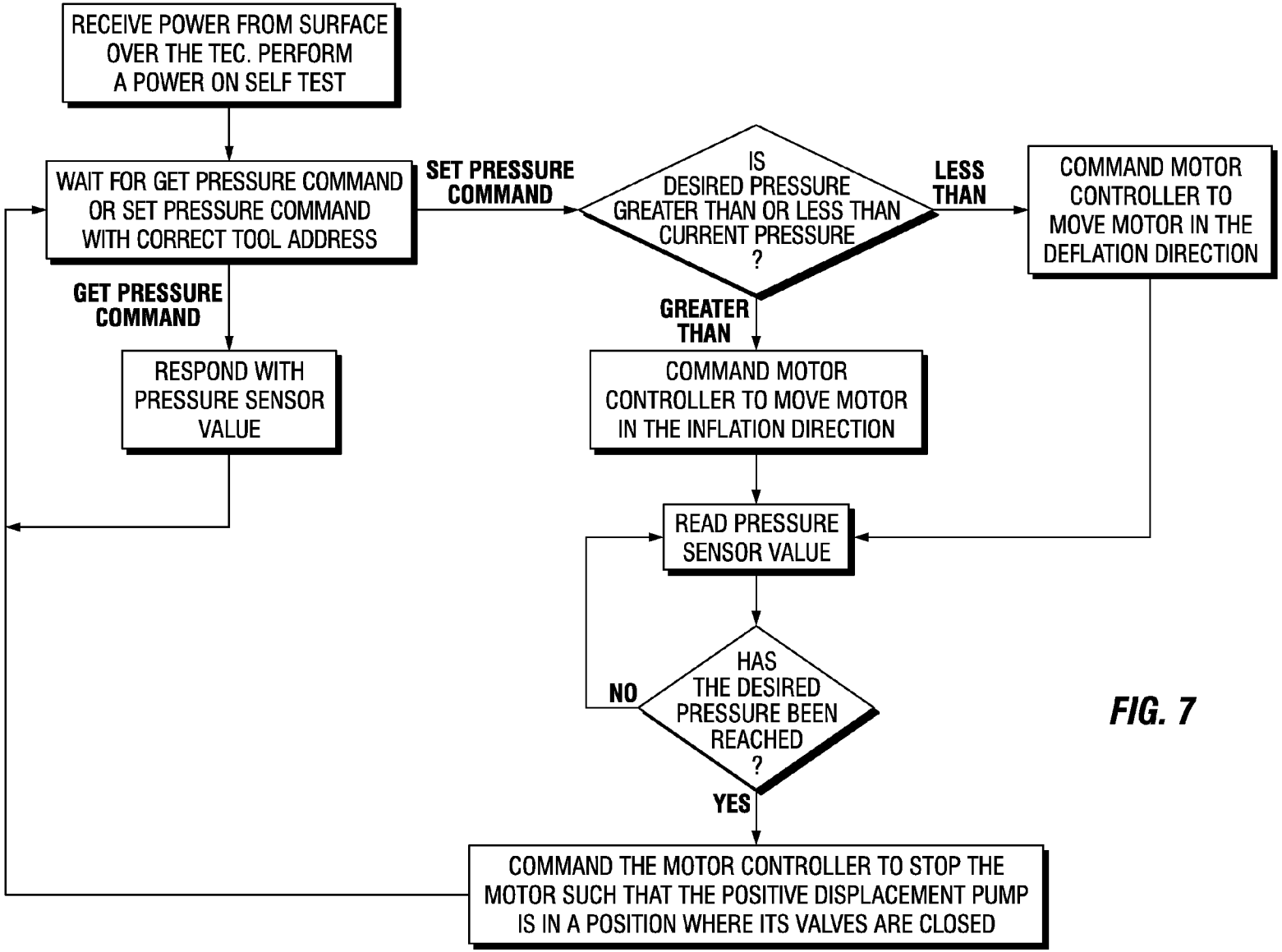
FIG. 7 is a flow-chart showing inflation/deflation steps performed by software loaded into the downhole processing unit and/or the microcontroller in one specific embodiment of the operation of the sealing device of FIG. 2.

Referring now to FIGS. 5-7, operation of the sealing devices can be controlled by software loaded into one or both of the surface processing unit or the microcontroller. Referring to FIG. 5, software is loaded into the surface processing unit that is capable of storing instructions for the downhole configuration of the sealing device being disposed in the wellbore. Power is then applied to the electronic communication line, e.g., the tubing encapsulated conductor ("TEC"). The operator can then input parameters for the "Set Pressure Command" for each sealing device. The "Set Pressure Command" parameters include the pressure at which the sealing device is to be inflated or deflated. The "Set Pressure Command" is then sent from the surface processing unit to the specific sealing device as determined by the sealing device's unique "address." The pressure parameter is then logged on the surface in the configuration file of the surface processing unit for use in the surface acquisition loop (FIG. 6).

Referring to FIG. 6, software loaded into the surface processing unit also instructs the microcontroller to activate the motor, which in turn activates the pump. As a result, fluid is pumped into the expandable sealing element unit until the "set pressure" is reached. The software in the surface processing unit monitors the pressure as determined by a pressure sensor operatively associated with the expandable sealing element. If the pressure reading by the pressure sensor that is being communicated to the surface processing unit is outside of an error threshold, an alert is displayed at the surface processing unit so that corrective action can be taken by the operator. For example, the operator can cause the software in the surface processing unit to send a signal to the microcontroller to activate or inactivate the motor and, thus, the pump, causing modification of the pressure within the expandable sealing element. In an alternative embodiment, the microcontroller can be programmed by software to automatically turn-on or turn-off the motor and, thus, the pump to modify the pressure within the expandable sealing element. In addition to alerting the operator at the surface processing unit, the alert can also be sent over wireless communication networks, e.g., cell phone, WiFi and the like, to alert operators located remotely from the surface processing unit.

As illustrated in FIG. 7, software loaded into the microcontroller is operatively associated with the surface processing unit. The microcontroller receives either a "Set Pressure Command" or a "Get Pressure Command." Upon receiving a Set Pressure Command, the software in the microcontroller compares the "set pressure" parameter of the Set Pressure Command to the actual or current pressure within the expandable sealing device. If the "set pressure" of the Set Pressure Command is less than the pressure reading of the expandable sealing element provided by the pressure sensor, then the microcontroller activates the motor and the pump to deflate the expandable sealing element until the desired set pressure is reached. If the "set pressure" of the Set Pressure Command is greater than the pressure reading of the expandable sealing element provided by the pressure sensor, the microcontroller activates the motor and the pump to inflate the expandable sealing element until the desired pressure is reached. The pressure sensor operatively associated with the expandable sealing element provides feedback to the microcontroller so that the pressure within the expandable sealing element can be compared to the Set Pressure Command. After the desired pressure, i.e., the "set pressure," is reached, the microcontroller stops the motor, closes the valves of the pump, and holds the sealing device in the set position (FIG. 3).

With continued reference to FIG. 7, upon receiving a Get Pressure Command, the downhole microcontroller responds to the surface with the current pressure sensor reading. This command is used by the surface processing unit acquisition loop shown in FIG. 6.

It is to be understood that the invention is not limited to the exact details of construction, operation, exact materials, or embodiments shown and described, as modifications and equivalents will be apparent to one skilled in the art. For example, the housing containing the pump and, if included, the motor, microcontroller, etc. can be included within its own separate sub assembly that is releasably secured within the work or tool string. Alternatively, these components can be included in a collar releasably or permanently secured to the mandrel. Moreover, the pump is not required to cause inflation of the expandable sealing element. Instead, a burst disk and check valve along with hydrostatic pressure can be used to inflate the expandable sealing element and the pump can be used to deflate the expandable sealing element. In addition, the sealing device is not required to be a packer, or a packer as described with respect to FIGS. 1-3. The sealing device may be any other downhole tool that provides a seal between the downhole tool and an inner wall surface of an opened-hole wellbore. The sealing device may also be part of any other downhole tool that provides compression to create a seal between two surfaces, regardless of whether the seal isolates an opened-hole wellbore. Moreover, filter or screen 52 on pump 50 is not required. In addition, the inlet of the pump is not required to be in fluid communication with the bore of the mandrel. Instead, the inlet of the pump can be in fluid communication with the wellbore. Further, the fluid used to inflate the expandable sealing element can be any desired fluid including wellbore fluid, hydraulic fluid, cement, and the like. In addition, the pump can be used to inflate, deflate, or both inflate and deflate the expandable sealing element. Accordingly, the invention is therefore to be limited only by the scope of the appended claims.

What is claimed is:

1. A sealing device for use in an open-hole wellbore to isolate an annulus of the open-hole wellbore, the sealing device comprising:

a mandrel having a mandrel outer wall surface, and a mandrel inner wall surface defining a mandrel bore;

an expandable sealing element disposed on the mandrel outer wall surface, the expandable sealing element having a sealing element outer wall surface, a sealing element inner wall surface defining a sealing element chamber, a run-in position, and a set position, the sealing element chamber being in selective fluid communication with a mandrel or annulus port, the port being in fluid communication with a fluid source, said set position has said sealing element contacting the open hole wellbore for annulus isolation as between opposed ends of said sealing element;

an electrically-activated pump operatively associated with the port and the sealing element chamber and located outside said mandrel bore, the electrically-activated pump having an inlet in fluid communication with the fluid source through the port, and an outlet in fluid communication with the sealing element chamber; and a power source mounted adjacent to said sealing element and located outside said mandrel bore and operatively associated with the electrically-activated pump, wherein the electrically-activated pump transports a fluid from the fluid source through the inlet, out of the outlet, and into the sealing element chamber to inflate the expandable sealing element from the run-in position to the set position, and wherein the electrically-activated pump transports the fluid from the sealing element chamber through the outlet, and out of the inlet to deflate the expandable sealing element from the set position toward the run-in position.

2. The sealing device of claim 1, wherein the electrically-activated pump is capable of holding the expandable sealing element in the set position.

3. The sealing device of claim 1, further comprising a valve disposed in the outlet to facilitate movement of the fluid from the sealing element chamber through the outlet, and through the inlet.

4. The sealing device of claim 1, wherein the port is disposed through the mandrel outer wall surface and the mandrel inner wall surface and in fluid communication with the mandrel bore, and the fluid source comprises the mandrel bore.

5. The sealing device of claim 1, wherein the electrically-activated pump and the power source are in electronic communication with a processing unit in electronic communication with an electronic communication line.

6. The sealing device of claim 1, further comprising a valve disposed in a deflation passage, the deflation passage being in selective fluid communication with the fluid source and the sealing element chamber by the valve for selective deflation of the expandable sealing element from the set position toward the run-in position.

7. The sealing device of claim 6, wherein the valve is a solenoid actuated valve in electronic communication with a processing unit.

8. A sealing device for use in an open-hole wellbore to isolate an annulus of the open-hole wellbore, the sealing device comprising:

a mandrel having a mandrel outer wall surface, and a mandrel inner wall surface defining a mandrel bore;

an expandable sealing element disposed on the mandrel outer wall surface, the expandable sealing element having a sealing element outer wall surface, a sealing element inner wall surface defining a sealing element chamber, a run-in position, and a set position, the sealing element chamber being in selective fluid communication with a mandrel or annulus port, the port being in fluid communication with a fluid source, said set position has said sealing element contacting the open hole wellbore for annulus isolation;

an electrically-activated pump operatively associated with the port and the sealing element chamber, the electrically-activated pump having an inlet in fluid communication with the fluid source through the port, and an outlet in fluid communication with the sealing element chamber; and a power source operatively associated with the electrically-activated pump, wherein the electrically-activated pump transports a fluid from the fluid source through the inlet, out of the outlet, and into the sealing element chamber to inflate the expandable sealing element from the run-in position to the set position, and wherein the electrically-activated pump transports the fluid from the sealing element chamber through the outlet, and out of the inlet to deflate the expandable sealing element from the set position toward the run-in position;

wherein the port is disposed through the sealing element outer wall surface and the sealing element inner wall surface and in fluid communication with the sealing element chamber, and the fluid source comprises an annulus of the wellbore.

9. A method of sealing an open-hole wellbore to divide an annulus of the open-hole wellbore, the method comprising:

(a) electrically activating a first downhole pump located outside a bore of a mandrel and operatively associated with a first expandable sealing element of a first sealing device mounted to said mandrel causing a first fluid to flow into a chamber of the first expandable sealing element to inflate the first expandable sealing element;

(b) continuing to pump the first fluid into the chamber of the first expandable sealing element until an outer wall surface of the first expandable sealing element engages with an inner wall surface of a wellbore; and (c) maintaining the first downhole pump in a first downhole pump stationary set position causing the outer wall surface of the first expandable sealing element to be maintained in contact with the inner wall surface of the wellbore to define a first isolated zone within the wellbore while maintaining clear said bore of said mandrel.

10. The method of claim 9, wherein after step (c) the first downhole pump is activated causing the first fluid within the chamber of the first expandable sealing element to flow out of the chamber of the first expandable sealing element to deflate the first expandable sealing element.

11. The method of claim 9, wherein during step (c) a wellbore fluid is flowed from a wellbore annulus through a first fluid control valve disposed in fluid communication with the first isolated zone.

12. The method of claim 9, further comprising the steps of:

(d) electrically activating a second downhole pump operatively associated with a second expandable sealing element of a second sealing device causing a second fluid to flow into a chamber of the second expandable sealing element to inflate the second expandable sealing element;

(e) continuing to pump the second fluid into the chamber of the second expandable sealing element until an outer wall surface of the second expandable sealing element engages with the inner wall surface of the wellbore; and (f) maintaining the second downhole pump in a second downhole pump set position causing the outer wall surface of the second expandable sealing element to be maintained in contact with the inner wall surface of the wellbore to define a second isolated zone within the wellbore.

13. The method of claim 12, further comprising the steps of:

(g) electrically activating a third downhole pump operatively associated with a third expandable sealing element of a third sealing device causing a third fluid to flow into a chamber of the third expandable sealing element to inflate the third expandable sealing element;

(h) continuing to pump the third fluid into the chamber of the third expandable sealing element until an outer wall surface of the third expandable sealing element engages with the inner wall surface of the wellbore; and (i) maintaining the third downhole pump in a third downhole pump set position causing the outer wall surface of the third expandable sealing element to be maintained in contact with the inner wall surface of the wellbore to define a third isolated zone within the wellbore.

14. The method of claim 13, wherein during step (0 a first wellbore fluid is flowed from a wellbore annulus through a first fluid control valve disposed in fluid communication with the second isolated zone.

15. The method of claim 14, wherein after step (i) the third downhole pump is activated causing the third fluid within the chamber of the third expandable sealing element to flow out of the chamber of the third expandable sealing element to deflate the third expandable sealing element.

16. The method of claim 15, wherein after the third expandable sealing element is deflated, flowing a second wellbore fluid from the wellbore annulus through the first fluid control valve.

17. The method of claim 16, wherein the first fluid and the second fluid comprise the same fluid.

18. The method of claim 17, wherein the third fluid comprises the same fluid as the first and second fluids.

19. The method of claim 12, wherein steps (a) and (d) are selectively performed by a processing unit in electronic communication with the first downhole pump and the second downhole pump.

20. The method of claim 9, wherein during step (c), a pressure sensor operatively associated with the first expandable sealing element communicates electronically with a processing unit electronically associated with the first downhole pump to maintain the first downhole pump in the first downhole pump set position.

21. The method of claim 9, wherein the first fluid is flowed from a tubular bore into the chamber of the first expandable sealing element during step (a).

22. The method of claim 9, wherein the first fluid is flowed from an annulus of the wellbore into the chamber of the first expandable sealing element during step (a).

23. The method of claim 9, wherein during step (c) gas migration between the outer wall surface of the first expandable sealing element and the inner wall surface of the openhole wellbore is prevented.

* * * * *